US010442647B2

(12) United States Patent
Seki et al.

(10) Patent No.: US 10,442,647 B2
(45) Date of Patent: Oct. 15, 2019

(54) MAGNET SHEET WINDING DEVICE AND PROPPING TOOL THEREOF

(71) Applicant: Izumi-Cosmo Co., Ltd., Osaka-shi, Osaka (JP)

(72) Inventors: Kazuharu Seki, Tokyo (JP); Shuhei Kameda, Tokyo (JP); Teruyuki Abe, Tokyo (JP)

(73) Assignee: IZUMI-COSMO CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 16/225,926

(22) Filed: Dec. 19, 2018

(65) Prior Publication Data

US 2019/0193973 A1 Jun. 27, 2019

(30) Foreign Application Priority Data

Dec. 21, 2017 (JP) ..... 2017-245127
Nov. 22, 2018 (JP) ..... 2018-219321

(51) Int. Cl.

| | |
|---|---|
| ***B65H 18/08*** | (2006.01) |
| ***B65H 75/28*** | (2006.01) |
| ***B43L 1/00*** | (2006.01) |
| ***B65H 75/26*** | (2006.01) |
| ***B43L 5/00*** | (2006.01) |
| ***B65H 75/22*** | (2006.01) |

(52) U.S. Cl.

CPC ..... *B65H 18/08* (2013.01); *B43L 1/008* (2013.01); *B43L 5/005* (2013.01); *B65H 75/22* (2013.01); *B65H 75/26* (2013.01); *B65H 75/28* (2013.01); *B65H 2401/213* (2013.01); *B65H 2701/1714* (2013.01); *B65H 2701/526* (2013.01)

(58) Field of Classification Search

CPC ..... G03B 21/58; B43L 1/045
USPC ..... 242/118, 600, 607; 359/461
See application file for complete search history.

(56) References Cited

U.S. PATENT DOCUMENTS

| | | | | |
|---|---|---|---|---|
| 4,406,422 | A * | 9/1983 | Philips | B65H 75/22 242/118.4 |
| 5,967,454 | A * | 10/1999 | Yarnell | B65H 75/22 242/118.32 |
| 9,690,182 | B2 * | 6/2017 | Abe | G09F 7/04 |
| 2012/0153069 | A1 * | 6/2012 | Allwood | B65H 49/32 242/607 |

FOREIGN PATENT DOCUMENTS

| | | | | |
|---|---|---|---|---|
| JP | 4221138 | B2 | 2/2009 | |
| JP | 5233870 | B2 | 7/2013 | |
| JP | 6423131 | B2 * | 10/2018 | B41L 1/08 |

* cited by examiner

*Primary Examiner* — Christopher E Mahoney
(74) *Attorney, Agent, or Firm* — Flynn Thiel, P.C.

(57) ABSTRACT

A cylindrical winding tool 3 has three elongated members 5 obtained by splitting a cylindrical member in its axial direction into multiple pieces. The elongated members are interconnected in a hinged state in a circumferential direction by the magnet sheet. When the elongated members 5 are to be used, the elongated members 5 are placed in a spread state and arranged on the magnetically-attached object 4. When the elongated members 5 are not used, the elongated members 5 are gathered together in the circumferential direction, abutment sections 5*b* of the end faces of the adjacent elongated members are brought into abutment on each other and thus the cylindrical winding tool 3 having a required diameter can be formed.

9 Claims, 10 Drawing Sheets

(a)

(b)

(a)

(b)

MAGNET SHEET WINDING DEVICE AND PROPPING TOOL THEREOF

BACKGROUND OF THE INVENTION

Field of the Invention

The present invention relates to a device for rewinding a magnet sheet (which will be called "a magnet sheet winding device" throughout this specification) and a tool for propping the device (which will be called "a propping tool" throughout this specification) and more particularly relates to a magnet sheet winding device capable of rewinding a magnetic sheet by a cylindrical winding tool when the magnetic sheet is not used and a propping tool therefor.

Description of the Related Art

An existing magnet sheet winding device often includes a magnet sheet having flexibility and a cylindrical winding tool having a predetermined diameter and attached to one side of the magnet sheet for rewinding the magnet sheet. When the magnet sheet is to be used (which may also be described to as "in an in-use state" throughout this specification) on the traditional device, the magnet sheet is unrolled from the cylindrical winding tool and magnetically attached to a magnetically-attached object. When the magnet sheet is not used (which may also be described to as "in an unused state" throughout this specification), the device rewinds the magnet sheet on the cylindrical winding tool (for example, see Japanese Patent No. 4221138).

According to the winding device having the above-described configuration, the magnet sheet in the in-use state is unrolled from the cylindrical winding tool and magnetically attached to the magnetically-attached object, and thereby the magnet sheet is allowed to be used as a sheet for a whiteboard or as a reflective screen for a projector such as a cinematographic projector. On the other hand, the magnet sheet can be rewound by the cylindrical winding tool when the magnetic sheet is not used, so that the winding device can be placed in storage in a compact fashion.

Also, another traditionally existing magnet sheet winding device includes, in place of the above-described cylindrical winding tool, a plurality of bar-like magnets which are attached in parallel with each other to one side of a magnet sheet (for example, see Japanese Patent No. 5233870).

According to this magnet sheet winding device, the bar-like magnets can be spread in response to the magnetic sheet being unrolled in an in-use state. On the other hand, in an unused state, the magnet sheet can be rewound on and about the multiple bar-like magnets.

SUMMARY OF THE INVENTION

According to the former winding device, when the magnet sheet is unrolled from the cylindrical winding tool in an in-use state and magnetically attached to the magnetically-attached object, the cylindrical winding tool remains to be attached to the one side of the magnet sheet. As a result, the cylindrical winding tool may interfere with the range of vision from the one side of the magnet sheet. Also, in a case where the magnet sheet is to be used as a whiteboard, the cylindrical winding tool may be a hindrance when a portion of the sheet adjacent to the cylindrical winding tool needs to be used. On the other hand, since a cylindrical winding tool having a required diameter can be adjusted in advance to have a diameter appropriate for rewinding the magnet sheet without causing creases thereon, the former winding device is advantageous in that it can smoothly rewind the magnet sheet about the cylindrical winding tool without causing creases thereon.

In contrast, according to the latter winding device, since the multiple bar-like magnets can also be spread in response to the magnet sheet being unrolled in an in-use state, the latter winding device is more advantageous than the former in that it can prevent the cylindrical winding tool from acting as a hindrance. On the other hand, a drawback of the latter device is that, when the magnetic sheet is rewound about the multiple bar-like magnets, it is difficult to equalize the outer diameters of the multiple magnets, which makes it difficult to realize smooth winding of the magnet sheet. In addition, creases are often created in the magnet sheet.

In view of such circumstances, an object of the present invention is to provide a magnet sheet winding device capable of smoothly rewinding the magnet sheet without causing creases thereon, and capable of preventing the cylindrical winding tool from acting as an interference, and to provide a propping tool suitable for the magnet sheet winding device.

The invention of claim 1 provides a magnet sheet winding device including a magnet sheet having flexibility and a cylindrical winding tool having a required diameter, attached to one side of the magnet sheet, and configured to rewind the magnet sheet, wherein the magnet sheet in an in-use state is unrolled from the cylindrical winding tool and magnetically attached to a magnetically-attached object and the magnet sheet in an unused state is rewound on the cylindrical winding tool. The magnet sheet winding device is characterized by the following.

The cylindrical winding tool comprises a plurality of elongated members obtained by splitting a cylindrical member in an axial direction of the cylindrical member.

The elongated members are connected in a hinged state to each other in a circumferential direction.

The elongated members are spread in the in-use state such that the elongated members are allowed to be arranged on the magnet sheet unrolled on the magnetically-attached object so as to be flush with the magnet sheet.

The elongated members in the unused state are gathered together in the circumferential direction. Abutment sections of end faces of the adjacent elongated members are brought into abutment on each other so as to form the cylindrical winding tool having the required diameter.

The invention of claim 9 provides a propping tool for the magnet sheet winding device according to any one of claims 1 to 8. The propping tool is characterized by the following.

The propping tool includes a magnetic attachment section configured to be magnetically attached to the magnetically-attached object, two expanded sections protruding obliquely frontward from the magnetic attachment section, and a fall prevention member provided between ends of the expanded sections.

The winding device in the unused state is positioned between the expanded sections in a state where the magnetic attachment section is magnetically attached to the magnetically-attached object, and the fall prevention member is provided in the expanded section to prevent a fall.

According to the magnet sheet winding device according to the invention of claim 1, the elongated member in the in-use state can be spread and the elongated members can be arranged on the magnet sheet unrolled on the magnetically-attached object such that the elongated members reside on the same plane as that on which the magnet sheet resides. Accordingly, the amount of protrusion of the elongated members from the magnetically-attached object can be made smaller, by virtue of which the elongated members constituting the cylindrical winding tool are prevented from interfering with the range of vision from the one side of the magnet sheet and acting as a hindrance to the actual use.

In addition, when the elongated members are not used, the elongated members can be gathered together in the circumferential direction, the abutment sections of the end faces of the adjacent elongated members can be brought into abutment on each other, and thus the cylindrical winding tool having the required diameter can be formed. Accordingly, it is made possible to obtain the effect that the magnet sheet can be rewound on the cylindrical winding tool smoothly without causing creases thereon.

Further, according to the propping tool according to the invention of claim 9, the propping tool can retain the winding device such that it does not fall even when the winding device cannot be retained on the magnetically-attached object by the magnetic force.

DETAILED DESCRIPTION OF THE PREFERRED EMBODIMENTS

Figure 1:
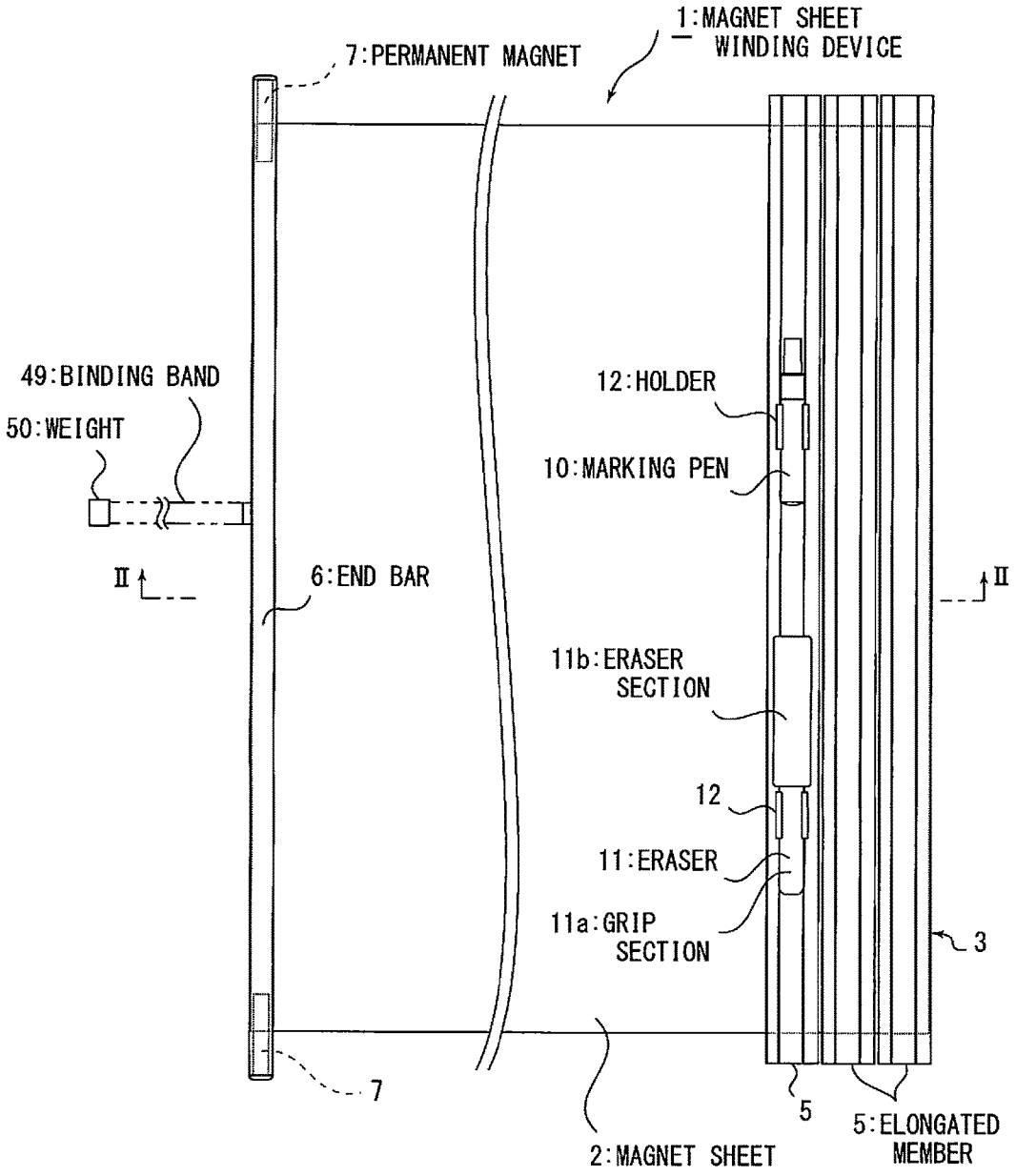
FIG. 1 is a front view illustrating a first embodiment of the present invention.
Figure 2:
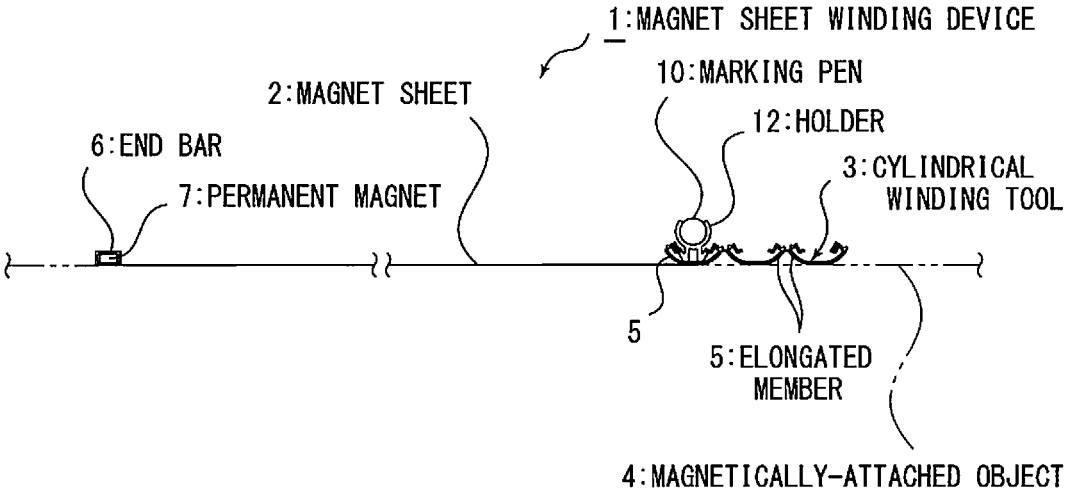
FIG. 2 is a cross-sectional view taken along the line II-II in FIG. 1.

Embodiments of the present invention will be described hereinbelow with reference to the drawings. FIG. 1 is a front view depicting an in-use state of the magnet sheet winding device 1 according to the present invention. FIG. 2 is a cross-sectional view taken along the line II-II in FIG. 1.

The winding device 1 includes a magnet sheet 2 having flexibility and a cylindrical winding tool 3 attached to one side of the magnet sheet 2 (which corresponds to the right side in FIG. 1) and configured to rewind the magnet sheet 2. When the winding device 1 is to be used, the magnet sheet 2 is drawn out of the cylindrical winding tool 3 and unrolled to be magnetically attached to a magnetically-attached object 4 such as a blackboard and whiteboard (FIG. 2).

Meanwhile, the cylindrical winding tool 3 according to this embodiment comprises, as will be described later, three elongated members 5 each having an arcuate cross section obtained by cutting a cylindrical member into three pieces along the axis of the cylindrical member. When the winding device 1 is to be used, the elongated members 5 are taken out of the state where they define a cylindrical body (see FIG. 3*b*) and spread on the same plane as that on which the magnet sheet 2 resides so as to be individually magnetically attached to the magnetically-attached object 4.

An end bar 6 is provided on the other side of the magnet sheet 2 (which corresponds to the left side in FIG. 1). Specifically, the end bar 6 is hollow over its entire length and has a rectangular cross section. Also, the end bar 6 is fixed by an adhesive, etc. to the magnet sheet 2 in a heightwise direction defined by the height of the magnet sheet 2. Rectangular permanent magnets 7 are fixed by a glue agent, etc. at the upper and lower locations, respectively, of the inside of the end bar 6.

The magnet sheet 2 is magnetically attached by its own magnetism to the magnetically-attached object 4 and, at the same time, the left end portion of the magnet sheet 2 is magnetically attached to the permanent magnet 7 provided in the end bar 6, as a result of which reliable magnetic attachment of the left end portion of the magnet sheet 2 can be ensured and warpage can be prevented.

Traditionally known magnetic sheets having flexibility and exhibiting magnetism with various configurations and compositions can be used as the magnet sheet 2. For example, it is possible to use a sheet for use in both a writing board and a reflective screen including sheets having magnetism and having a special coating layers provided upon a front surface and back surface, respectively, of a base material such as a plastic film.

Figure 3:
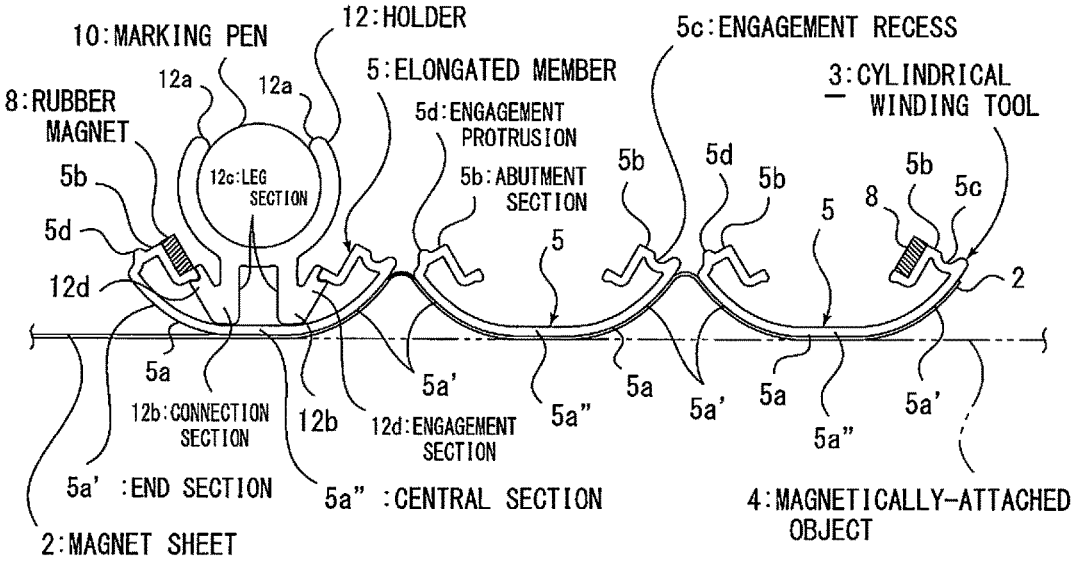
FIG. 3 is a cross-sectional view illustrating a cylindrical winding tool 3 in an enlarged view.
Figure 3:
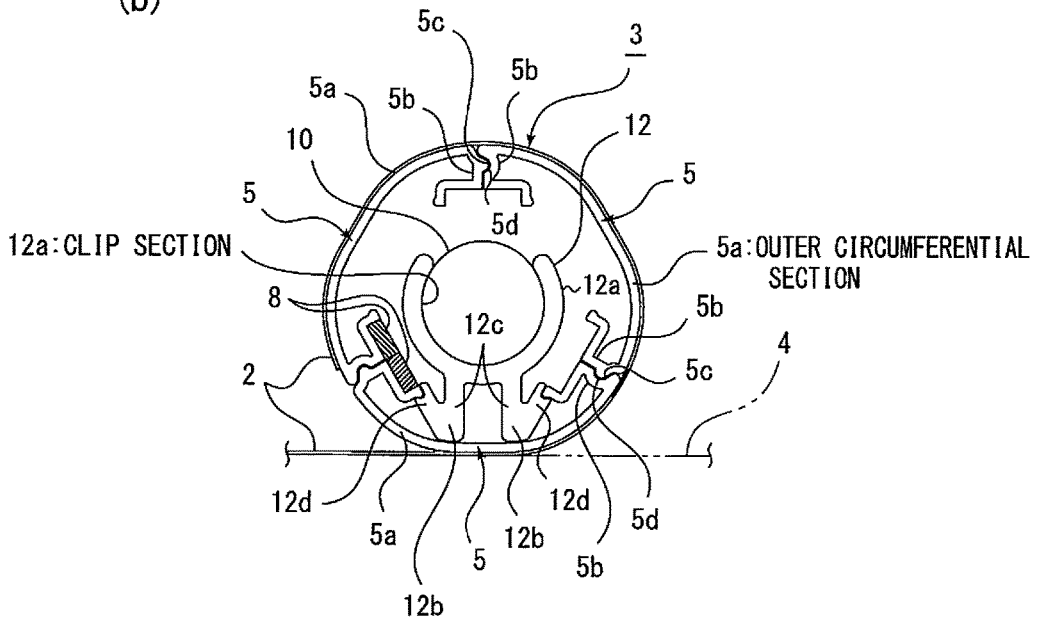

FIG. 3*a* is a cross-sectional view of the cylindrical winding tool 3 in the in-use state. FIG. 3*a* is an enlarged cross-sectional view of the cylindrical winding tool 3 illustrated in FIG. 2. Also, FIG. 3*b* is a cross-sectional view that illustrates a cylindrical winding tool 3 having a predetermined required diameter obtained by concentrating the individual elongated members 5 in a circumferential direction when the winding device 1 is not used. In this state, the magnet sheet 2 is allowed to be rewound by the cylindrical winding tool 3.

The cylindrical winding tool 3 comprises, as described above, the three elongated members 5 each having an arcuate cross section obtained by splitting a cylindrical member into three equal pieces in its axial direction, the elongated members 5 are each connected in a hinged state to the adjacent one or ones of the elongated members 5, 5.

In this embodiment, as illustrated in FIG. 3*b*, the respective elongated members 5 are concentrated in the circumferential direction to form a cylindrical winding tool 3, where the circumferential direction is defined with reference to the circumference of the cylindrical winding tool 3, and in this state, the left end portion of the magnet sheet 2 is wound around the outer circumferential surface of the cylindrical winding tool 3, and the rewound portion is fixed to the elongated members 5 by an adhesive, etc. In addition, as illustrated in FIG. 3*a*, when the elongated members 5 are spread, the elongated members 5 are connected to each other by virtue of the left end portion of the magnet sheet 2. In other words, in this embodiment, two adjacent elongated members 5, 5 are interconnected in a hinged state by the magnet sheet 2.

The elongated members 5 have the same shape and each include arcuate outer circumferential sections 5*a*, which define an outer circumferential surface when the elongated members 5 are gathered together, and abutment sections 5*b* each protruding radially inwardly at corresponding one of both of the ends of the outer circumferential sections 5*a*, where the abutment sections 5*b* define an end surface.

The outer circumferential surfaces of the arcuate outer circumferential sections 5*a* are formed in an arcuate shape with the same curvature to form the required diameter at both of the end sections 5*a*' which define the abutment sections 5*b* formed at both of the ends of each outer circumferential section 5*a*, but the outer circumferential surface is formed in a planar shape at the central section 5*a*" which defines the intermediate section between both of the end sections 5*a*'. As a result, when the elongated members 5 are spread, the magnet sheet 2 at the planar central section 5*a*" can be magnetically attached to the magnetically-attached object 4 in a stable state.

In addition, as illustrated in FIG. 3*a*, the magnet sheet 2 is fixed to the entire outer circumferential surface of the two elongated members 5 which will reside on the left side of the magnet sheet 2 when they are spread. Meanwhile, with regard to the outer circumferential surface of the elongated member 5 which will reside on the leftmost side when it is spread, the magnet sheet 2 is only fixed to the end section 5*a*' on the right side of the elongated member 5 and the central section 5*a*" thereof and is not fixed to the end section 5*a*' on the left side.

By virtue of this, the respective central sections 5*a*" of the three elongated members 5 can be magnetically attached to the magnetically-attached object 4 respectively via the magnet sheet 2, and the magnet sheet 2 that is unrolled further leftward from the leftmost elongated member 5 is magnetically attached to the magnetically-attached object 4 to be flush therewith.

The abutment sections 5*b* are configured to be brought into abutment on each other when the individual elongated members 5 are gathered together. An engagement recess 5*c* is formed on one of the mutually abutting abutment sections 5*b*, 5*b* in a longitudinal direction (axial direction) and an engagement protrusion 5*d* is formed on the other of these sections.

When the individual elongated members 5 are gathered together and the abutment sections 5*b*, 5*b* are brought into abutment on each other, then the engagement protrusion 5*d* is brought into engagement with the inside of the engagement recess 5*c*, by virtue of which the individual elongated members 5 are positioned in the circumferential direction and the cylindrical winding tool 3 having a required diameter can be formed in a stable state.

Further, a rubber magnet 8 is provided at the rightmost abutment section 5*b* residing at the rightmost side and another rubber magnet 8 is provided at the leftmost abutment section 5*b* residing at the leftmost side when the respective elongated members 5 are spread. When the cylindrical winding tool 3 is formed by gathering together of the elongated members 5, both of the rubber magnets 8 are magnetically attached to the elongated members 5 that have been gathered together so as to prevent them from being inadvertently spread.

As illustrated in FIGS. 1 and 2, a holder 12 for holding a marking pen 10 and an eraser 11 for a whiteboard is attached to the leftmost elongated member 5 residing in the leftmost location in a spread state.

The respective holder 12 is produced using synthetic resin and, as illustrated in FIG. 3*a* in an enlarged state, includes a C-shaped clip section 12*a* configured to hold a cylindrical portion of the marking pen 10 and the eraser 11, and two connection sections 12*b* provided at the central portion of the clip section 12*a* as a pair of corresponding sections. Each of the connection section 12*b* includes a leg section 12*c* extending outward in a radial direction defined with reference to a radius of the C-shaped clip section 12*a* and an engagement section 12*d* provided at the end of the leg section. One of the engagement sections 12*d* is brought into engagement with the abutment section 5*b* on the one side of the elongated member 5 and the other of the engagement sections 12*d* is brought into engagement with the abutment section 5*b* of the other side of the elongated member 5, and thereby the connection section 12*b* is detachably attached to the elongated member 5.

The marking pen 10 and the eraser 11 in a state where they are detachably attached to the holder 12 are accommodated in the cylindrical winding tool 3 when the respective elongated members 5 are gathered together and the cylindrical winding tool 3 is formed.

It should be noted that the eraser 11 includes a cylindrical grip section 11*a* and an eraser section 11*b* having a larger diameter than that of the grip section 11*a*. The eraser 11 is detachably attached to the holder 12 by bringing the grip section 11*a* into engagement with the C-shaped clip section 12*a*. Also, while FIG. 1 depicts the marking pen 10 attached to the elongated member 5, it will be appreciated that a greater number of the holders 12 may be provided such that multiple marking pens are allowed to be attached to the elongated member 5.

Given the above-described features, when the magnet sheet winding device 1 is to be used, the end bar 6 provided at the end of the magnet sheet 2 wound around the cylindrical winding tool 3 is first magnetically attached, using the permanent magnet 7 provided inside thereof, to the magnetically-attached object 4. Next, the cylindrical winding tool 3 is taken out of this state and made to rotationally move on the magnetically-attached object 4 such that the magnet sheet 2 is relatively drawn out of the cylindrical winding tool 3, and the magnet sheet 2 is unrolled on and magnetically attached to the magnetically-attached object 4.

In addition, when the cylindrical winding tool 3 is allowed to be exposed out of the magnet sheet 2, then the two rubber magnets 8 are detached from each other and the elongated members 5 that were gathered together are spread, and the elongated members 5 are magnetically attached via the magnet sheet 2 to the magnetically-attached object 4.

In this state, the amount of protrusion of the respective elongated members 5 from the magnetically-attached object 4 cam be made smaller than that in a state where the cylindrical winding tool 3 remains to be formed, so that it is made possible to reduce the possibility of the respective elongated members 5 acting as a hindrance to the range of vision or interfere with the actual use.

When the magnet sheet 2 is taken out of the above-described in-use state and rewound, the respective elongated members 5 that have been spread are first gathered together. At this point, the length of the hinge-connected section by the magnet sheet 2 is specified such that it corresponds to the length ensuing that the respective abutment sections 5*b*, 5*b* which are the respective end faces of the adjacent elongated members 5 are autonomously brought into abutment on each other when the elongated members 5 are gathered together.

In other words, the magnet sheet 2 is adhesively attached to the outer circumferential surface of the cylindrical winding tool 3 in a state where the individual elongated members 5 are gathered together and the cylindrical winding tool 3 is configured, as a result of which the length of the hinge-connected section by the magnet sheet 2 will be specified, as mentioned above, to such a length that the respective abutment sections 5*b*, 5*b* of the adjacent elongated members 5 are autonomously brought into abutment on each other when the individual elongated members 5 are gathered together.

In addition, in this embodiment, since the engagement recess 5*c* is provided on one of the mutually abutting abutment sections 5*b*, 5*b* and the engagement protrusion 5*d* is provided on the other of them, the respective elongated member 5 will be positioned in the circumferential direction through the engagement between the engagement recess 5*c* and the engagement protrusion 5*d*. Further, the rubber magnets 8 provided in the rightmost abutment section 5*b* which will reside at the rightmost position and the leftmost abutment section 5*b* which will reside at the leftmost position when the individual elongated members 5 are spread are magnetically attached to each other, so that the cylindrical winding tool 3 having a required diameter is allowed to be formed in a stable state.

When this state has been established, then the cylindrical winding tool 3 is made to rotationally move on the magnet sheet 2 on which it is spread and the magnet sheet 2 should be rewound on the cylindrical winding tool 3 in this state. At this point, it is preferable that the cylindrical winding tool 3 should rewind the magnet sheet 2 in advance and, since the cylindrical winding tool 3 is configured to have a diameter that would not create creases, it is made possible to rewind the magnet sheet 2 smoothly without causing creases thereon. After that, it should be bound by a band or put into a predetermined cylinder for storage.

It should be noted that the rubber magnet 8 may be omitted if needed.

Figure 4:
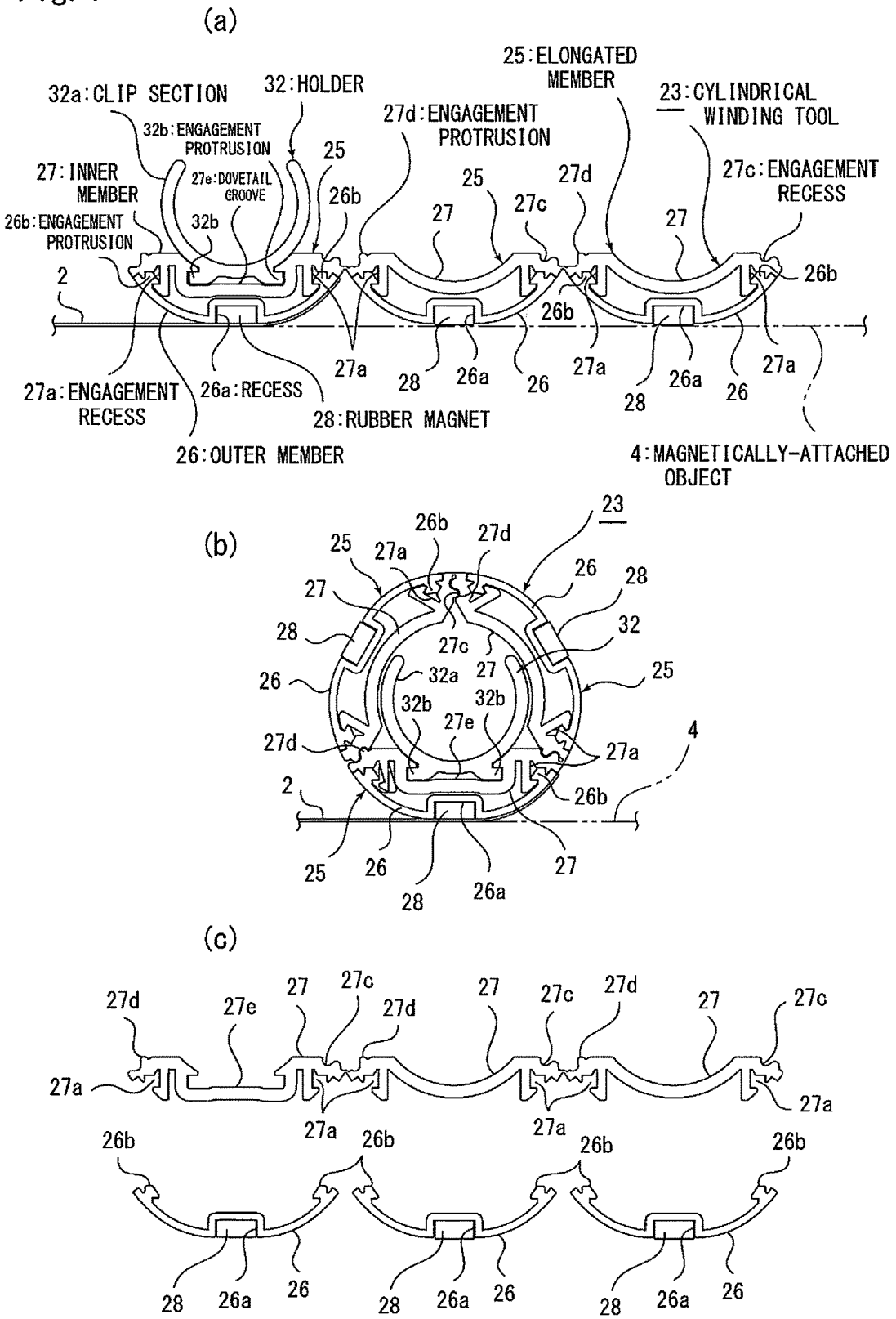
FIG. 4 is a cross-sectional view of the cylindrical winding tool according to a second embodiment of the present invention.

FIGS. 4*a*, 4*b*, and 4*c* illustrate the second embodiment of the present invention. While the adjacent elongated members 5, 5 are connected in a hinged state by the magnet sheet 2 in the above-described first embodiment, the elongated members 25, 25 constituting the cylindrical winding tool 23 in this embodiment are connected in a hinged state by a resin hinge produced in one piece with the synthetic resin constituting the respective elongated members 25.

More specifically, according to this embodiment, the elongated members 25 each comprise an outer member 26 and an inner member 27. The outer members 26 define the outer circumferential surface of the cylindrical winding tool 23 when they are gathered together, each of which are separately composed of a rigid member such as aluminum. A recess 26*a* extending in the longitudinal direction is formed at the central portion of the outer circumferential surface of the respective outer member 26, and a rubber magnet 28 for magnetically attaching the respective elongated member 25 to the magnetically-attached object 4 is provided inside the respective recess 26*a*.

The outer circumferential surface of each outer member 26 is configured such that the end sections are formed in an arcuate shape with the same curvature in the same manner as in the first embodiment except for the central portion where the recess 26*a* is formed while the surface of the respective rubber magnet 28 where it is magnetically attached to the magnetically-attached object 4 is formed to be flat, As a result, when the elongated members 25 are spread, the elongated members 25 are allowed to be magnetically attached to the magnetically-attached object 4 in a stable state.

The inner members 27 are each configured to be attached to corresponding inner circumferential surface side of the outer members 26. The three inner members 27 are produced using synthetic resin in one piece with each other, the adjacent inner members 27, 27 are connected to each other in one piece with each other by the synthetic resin. In addition, the connection sections define the resin hinge.

As illustrated in FIG. 4*c*, an engagement protrusion 26*b* is formed on each of both of the sides of the inner circumferential surface of each outer member 26 in the longitudinal direction. An engagement recess 27*a* is formed on each of the both sides of each inner member 27 in the longitudinal direction. When the engagement protrusion 26*b* and the engagement recess 27*a* are brought into engagement with each other, the outer member 26 and the respective inner member 27 are connected to each other in one piece with each other. The adjacent elongated members 25 are connected in a hinged state by the resin hinge.

Abutment sections which correspond to the abutment sections 5*b* of the first embodiment are formed on both sides of each inner member 27, respectively. An engagement recess 27*c* is provided on one of the mutually abutting abutment sections in the longitudinal direction and an engagement protrusion 27*d* is formed on the other of them. The engagement recess 27*c* and the engagement protrusion 27*d* correspond to the engagement recess 5*c* and the engagement protrusion 5*d*, respectively, of the first embodiment. The engagement recess 27*c* and the engagement protrusion 27*d* are brought into engagement with each other when the respective elongated members 25 are gathered together and the abutment sections are brought into abutment on each other.

Also, as illustrated in FIGS. 4*a* and 4*c*, a dovetail groove 27*e* is formed in the longitudinal direction on the inner member 27 of the leftmost elongated member 25 in the spread state so as to attach thereto the holder 32 that holds the marking pen 10 and the eraser 11 for the whiteboard.

The holders 32 are produced using synthetic resin. The holders 32 each include a C-shaped clip section 32*a* configured to hold a cylindrical portion of the marking pen 10 and the eraser 11, and two engagement protrusions 32*b* provided at the central portion of the clip section 32*a* as a pair of sections. When the engagement protrusion 32*b* is brought into engagement with the dovetail groove 27*e*, the holder 32 is attached to the inner member 27 in such a manner that the position of the holder 32 can be adjusted in the longitudinal direction defined with reference to the length of the dovetail groove 27*e*.

In this embodiment, since the individual elongated members 25 are connected in a hinged state to each other by the resin hinge, the right end portion of the magnet sheet 2 is only adhesively attached to the outer member 26 of the leftmost elongated member 25 which resides at the leftmost position when unrolled in the same manner as in the first embodiment and is not adhesively attached to the two outer members 26 residing on the right side of the elongated member 25. In addition, in order to magnetically attach the two outer members 26 to the magnetically-attached object 4, the above-described rubber magnet 28 is provided on all the elongated members 25 including these two outer members 26.

In the second embodiment having the above-descried features as well, it will be apparent that the same or equivalent functions and effects as those in the first embodiment can be obtained.

It should be noted that, in the second embodiment, the inner member 27 and the outer member 26 may be produced using synthetic resin in one piece with each other and the individual elongated members 25 may be connected in a hinged state using a resin hinge.

FIGS. 5*a*, 5*b*, and 5*c* illustrate the third embodiment of the present invention. In this embodiment as well, the cylindrical winding tool 43 comprises three elongated members 45 each having an arcuate cross section and obtained by splitting a cylindrical member in the axial direction into three equal pieces. The elongated members 45 are connected in a hinged state to adjacent elongated members 45, 45 using a tape 41 having flexibility.

In this embodiment, the individual elongated members 45 are configured in one piece with each other using a hollow member having an outer section 45*a* and an inner section 45*b*. The outer circumferential surface of each outer section 45*a* is formed such that both end portions thereof in the circumferential direction have an arcuate shape while the central section in the circumferential direction have a planar shape. As a result, in the same manner as in the above-described embodiment, when the individual elongated members 45 are spread, the individual elongated members 45 can be magnetically attached to the magnetically-attached object 4 in a stable state and the cylindrical winding tool 43 having a required diameter can be formed when the individual elongated members 45 are gathered together.

Both of the end faces in the circumferential direction of the individual elongated members 45 are formed to be flat except for the two end faces that become the right end portion and the left end portion in the spread state. The respective flat surfaces are defined to be the mutually abutting abutment section 45*c*. In contrast, the two end faces that become the right end portion and the left end portion in the spread state are also formed as the mutually abutting abutment sections 45*c* when the two end faces are also gathered together, but the engagement recess 45*d* is provided at one of the two abutment sections 45*c* and the engagement protrusion 45*e* is provided at the other of them. When the engagement recess 45*d* and the engagement protrusion 45*e* that have been gathered together are brought into engagement with each other, the cylindrical winding tool 43 can be formed in a stable state.

At this point, the tape 41 constituting the hinge connection is stretched tightly so as to interconnect the adjacent elongated members 45 in a state where the individual elongated members 45 are gathered together and cylindrical winding tool 43 is configured. By virtue of this, the length of the hinge-connected section by the tape 41 is specified such that it corresponds to the length ensuring that the respective abutment sections 5*b*, 5*b* of the adjacent elongated members 45 are autonomously brought into abutment on each other when the individual elongated members 45 are gathered together.

As illustrated in FIG. 5*c*, a cap 47 is attached to each of both of the ends of the hollow elongated member 45. The cap 47 includes an arcuate fitting engagement section 47*a* configured to be brought into fitting engagement with the hollow space of the elongated member 45 to be attached thereto, and includes a flange section 47*b* configured to be brought into abutment on the end face of the opening of the elongated member 45 in the longitudinal direction. Also, a permanent magnet 48 is attached to the inside of the flat section at the center of the fitting engagement section 47*a*.

Accordingly, when the cylindrical winding tool 43 is unrolled, the individual elongated members 45 can be magnetically attached to the magnetically-attached object 4 by the permanent magnet 48.

Also, in this embodiment, a binding band 49 (see FIG. 1) is provided at the central portion in the length of the end bar 6 provided at the left end portion of the magnet sheet 2. The binding band 49 is configured to maintain a winding state after the magnet sheet 2 is wound on the cylindrical winding tool 43. The binding band 49 comprises a hook-and-loop fastener. One end thereof is fixed to the central portion of the end bar 6 in the longitudinal direction. A weight 50 is fixed to the other end thereof.

The binding band 49 is wound around the outer circumference of the magnet sheet 2 after the magnet sheet 2 is rewound on the cylindrical winding tool 43 in the unused state, and the winding portions are fixed to each other by the hook-and-loop fastener, by means of which the winding state of the magnet sheet 2 can be stably maintained.

On the other hand, while FIG. 1 illustrates a state where the binding band 49 too is unrolled when the magnet sheet 2 is unrolled in the in-use state, the binding band 49 hangs in a stable state by the weight 50 such that the binding band 49 does not hinder actual use of the magnet sheet 2.

In the third embodiment having the above-described features as well, the same or similar functions and effects can be obtained as those of the first and second embodiments.

Figure 6:
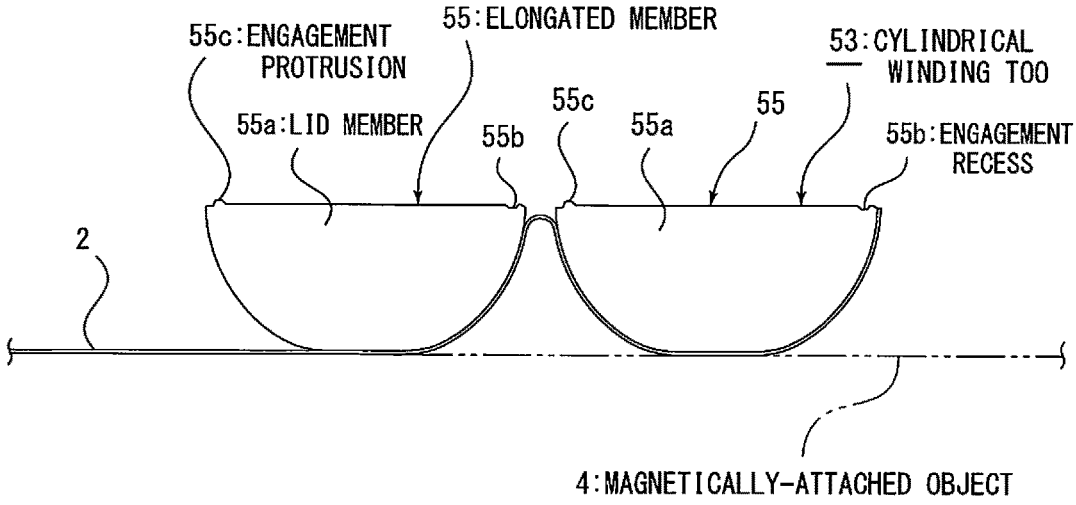
FIG. 6 is a cross-sectional view of the cylindrical winding tool according to a fourth embodiment of the present invention.
Figure 6:
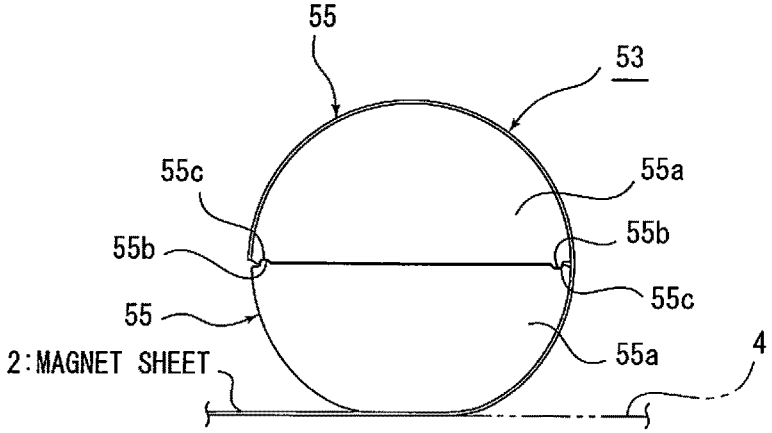

FIGS. 6*a* and 6*b* illustrate the fourth embodiment of the present invention. While all of the foregoing embodiments configure the cylindrical winding tool 3, 23, 43 by the three elongated members 5, 25, 45 obtained by splitting the cylindrical member in the axial direction into three equal pieces, this embodiment configures the cylindrical winding tool 53 by two elongated members 55 each having a semi-circular cross section and obtained by splitting a cylindrical member in the axial direction into two equal pieces.

The elongated member 55 according to this embodiment is also configured such that both of the end portions in the circumferential direction are formed in an arcuate shape while the central section in the circumferential direction is formed to be planar, by virtue of which, in the same manner as the foregoing embodiments, when the individual elongated members 55 are spread, the individual elongated members 55 can be magnetically attached to the magnetically-attached object 4 in a stable state.

Also, according to this embodiment, when the cylindrical winding tool 53 is formed by making the two elongated member 55 gathered together in the circumferential direction, a semi-circular lid member 55*a* is provided at both of the ends in the longitudinal direction of the individual elongated members 55 such that both of the ends of the cylindrical winding tool 53 are closed off.

An engagement recess 55*b* and an engagement protrusion 55*c* configured to be brought into engagement with each other are formed at both ends of the mating surface of the respective lid members 55*a*. When both of the elongated members 55 are gathered together and the cylindrical winding tool 53 is formed, the respective engagement recess 55*b* and the engagement protrusion 55*c* are brought into engagement with each other.

The hinge connection according to this embodiment uses the magnet sheet 2 in the same or similar manner as in the first embodiment. The right end portion of the magnet sheet 2 is adhesively attached to almost the entire outer circumferential surface of the elongated member 55 which becomes the right side in a spread state. Also, it is adhesively attached to the right half of the outer circumferential surface of the elongated member 55 which becomes the left side in the spread state.

By virtue of this, the two elongated members 55 are connected in a hinged state to each other by the magnet sheet 2 and, in the spread state, the respective central sections of the two elongated members 55 are allowed to be magnetically attached to the magnetically-attached object 4 respectively by the magnet sheet 2. In addition, the magnet sheet 2 that is unrolled to the left side beyond the elongated member 55 which becomes the left side is magnetically attached to the magnetically-attached object 4 such that it is flush therewith.

The length of the hinge connection by the magnet sheet 2 of this embodiment is specified in the same or similar manner as in the first embodiment. Accordingly, in this embodiment as well, the same or similar functions and effects can be obtained as those in the first to third embodiments.

Figure 7:
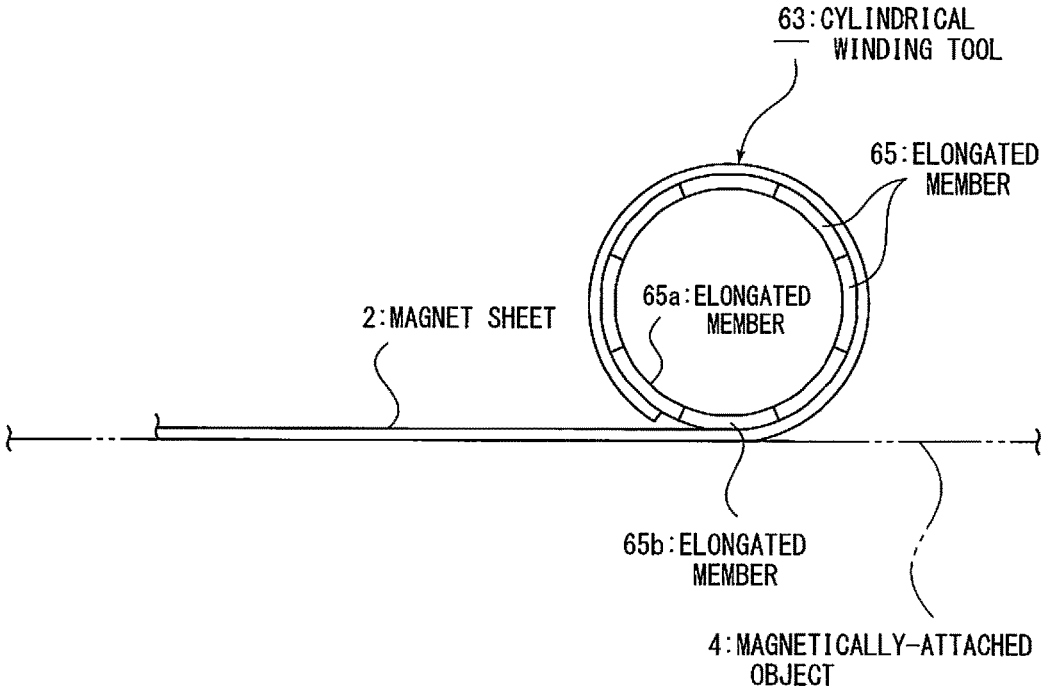
FIG. 7 is a cross-sectional view of the cylindrical winding tool according to a fifth embodiment of the present invention.

FIG. 7 illustrates the fifth embodiment of the present invention. In this embodiment, the cylindrical winding tool 63 comprises eight arcuate elongated members 65 obtained by splitting a cylindrical member in the axial direction into eight equal pieces. In addition, in the elongated member 65 according to this embodiment as well, the respective both end portions in the circumferential direction are formed in an arcuate shape while the central section in the circumferential direction is formed to be planar. As a result, in the same manner as in the foregoing embodiments, when the respective elongated members 65 are spread, the central portion of the respective elongated members 65 can be magnetically attached to the magnetically-attached object 4 in a stable state. Also, the cylindrical winding tool 63 having a required diameter can be formed when the respective elongated members 65 are gathered together.

In this embodiment, when the eight elongated member 65 are gathered together in the circumferential direction and the cylindrical winding tool 63 is formed, both of the end faces of the respective elongated members 65 in the circumferential direction are configured as abutment sections configured to be brought into abutment on each other in a state where both of the end faces are placed in an intimate contact with each other.

Also, hinge connection in this embodiment uses the magnet sheet 2 in the same or similar manner as in the first embodiment. When the right end portion of the magnet sheet 2 is adhesively attached to almost the entire outer circumferential surface of the elongated member 65*a* which becomes the right side in the spread state. In addition, it is adhesively attached to the entire outer circumferential surface of the other elongated member 65. In contrast, the elongated member 65*b* which becomes the left side in the spread state is adhesively attached to the right arcuate portion in the circumferential direction and the planar portion at the center and is not adhesively attached to the left arcuate portion in the circumferential direction.

In this manner, according to this embodiment, the eight elongated members 65 are connected in a hinged state to each other by the magnet sheet 2. In the spread state, the individual elongated members 65 are allowed to be magnetically attached to the magnetically-attached object 4 via the magnet sheet 2. In addition, the magnet sheet 2 unrolled to the left side beyond the elongated member 65*b* which becomes the left side is magnetically attached to the magnetically-attached object 4 such that it is flush therewith.

Also, when the magnet sheet 2 is to be rewound, the cylindrical winding tool 63 having a required diameter is allowed to be configured in a stable state by bringing the abutment sections of the eight elongated member 65 into abutment on each other in a state where they are placed in an intimate contact. Accordingly, in this embodiment as well, the same or similar functions and effects can be obtained as those in the first to fourth embodiments.

FIGS. 8*a* and 8*b* illustrate the sixth embodiment of the present invention. FIGS. 9*a* and 9*b* illustrate the seventh embodiment of the present invention. In the unused state of the winding device 1 where the magnet sheet 2 is rewound on the cylindrical winding tool 43, the winding device 1 can be retained in a state where the end bar 6 is magnetically attached to the magnetically-attached object 4.

A permanent magnet 7 having a strength enabling retention of the winding device 1 in the unused state by the magnetically-attached object 4 is accommodated in the end bar 6. Also, as illustrated in FIG. 1, a binding band 49 is provided at the central portion of the end bar 6 in the longitudinal direction.

Figure 5:
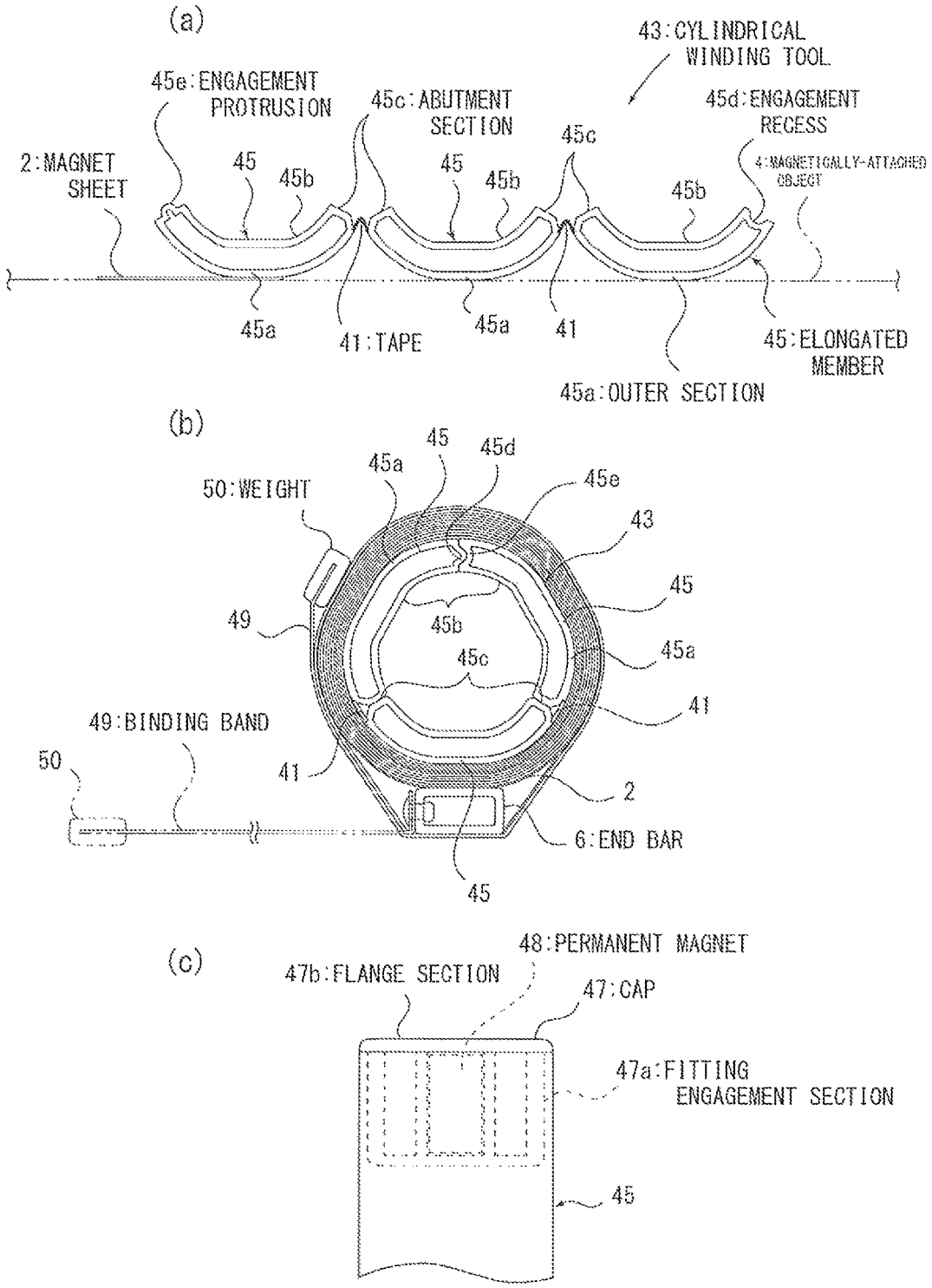
FIG. 5 is a cross-sectional view of the cylindrical winding tool according to a third embodiment of the present invention.

It should be noted that the cylindrical winding tool 43 of the winding device 1 described in the third embodiment illustrated in FIG. 5 is used for the sake of explanation of the winding device 1 according to these embodiments, but it will be appreciated that these embodiments are also applicable to the cylindrical winding tools 3, 23, 53, 64 of the other embodiments.

Figure 8:
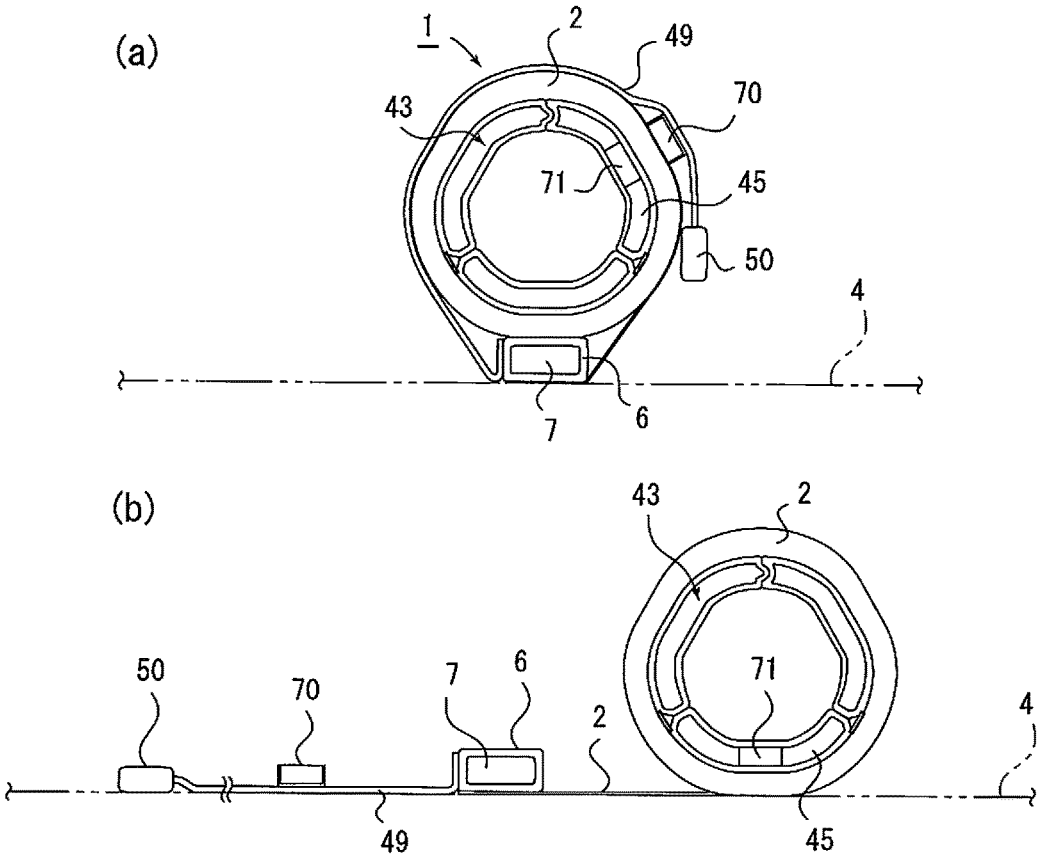
FIG. 8 is a cross-sectional view of the cylindrical winding tool according to a sixth embodiment of the present invention.

The winding device 1 according to the sixth embodiment will now be described below with reference to FIG. 8. In the winding device 1 of this embodiment, the binding band 49 comprises not a hook-and-loop fastener but a required material having flexibility. A permanent magnet 70 is provided at a location adjacent to the weight 50 inside the binding band 49.

The proximal end of the binding band 49 is fixed to the end bar 6. Also, the length of the portion of the binding band 49 protruding to the outer side beyond the end bar 6 is defined to be such a length that the outer circumference of the winding device 1 in the unused state can be wound by less than one round of winding. By virtue of this, it is ensured that the protruding portion does not pass the space between the magnetically-attached object 4 and the end bar 6.

The permanent magnet 70 in the in-use state is magnetically attached to the magnetically-attached object 4 to retain the binding band 49 on the magnetically-attached object 4. In the unused state, when the binding band 49 is rewound on the winding device 1, it is positioned on the planar portion of any of the elongated members 45 constituting the cylindrical winding tool 43.

In addition, a permanent magnet 71 is accommodated in the inside of the elongated member 45 where the permanent magnet 70 is positioned such that permanent magnet 71 attracts the permanent magnet 70. By the attraction of these permanent magnets 70, 71, the winding state of the magnet sheet 2 is stably maintained.

According to the sixth embodiment, the winding device 1 in the unused state can be magnetically attached to the magnetically-attached object 4 by the permanent magnet 7 provided in the end bar 6 (see FIG. 8*a*). Further, from this state, the permanent magnet 70 is detached from the outer circumference of the magnet sheet 2 to unroll the binding band 49, and in this state the magnet sheet 2 rewound on the cylindrical winding tool 43 can be unrolled on the magnetically-attached object 4 (see FIG. 8*b*).

In other words, when the magnet sheet 2 is to be unrolled, it is not necessary to detach the winding device 1 in the unused state temporarily from the magnetically-attached object 4; on the contrary, when the winding device 1 is taken out of the in-use state and placed in the unused state, the magnet sheet 2 can be rewound on the cylindrical winding tool 43 while the end bar 6 remains to be magnetically attached to the magnetically-attached object 4.

Figure 9:
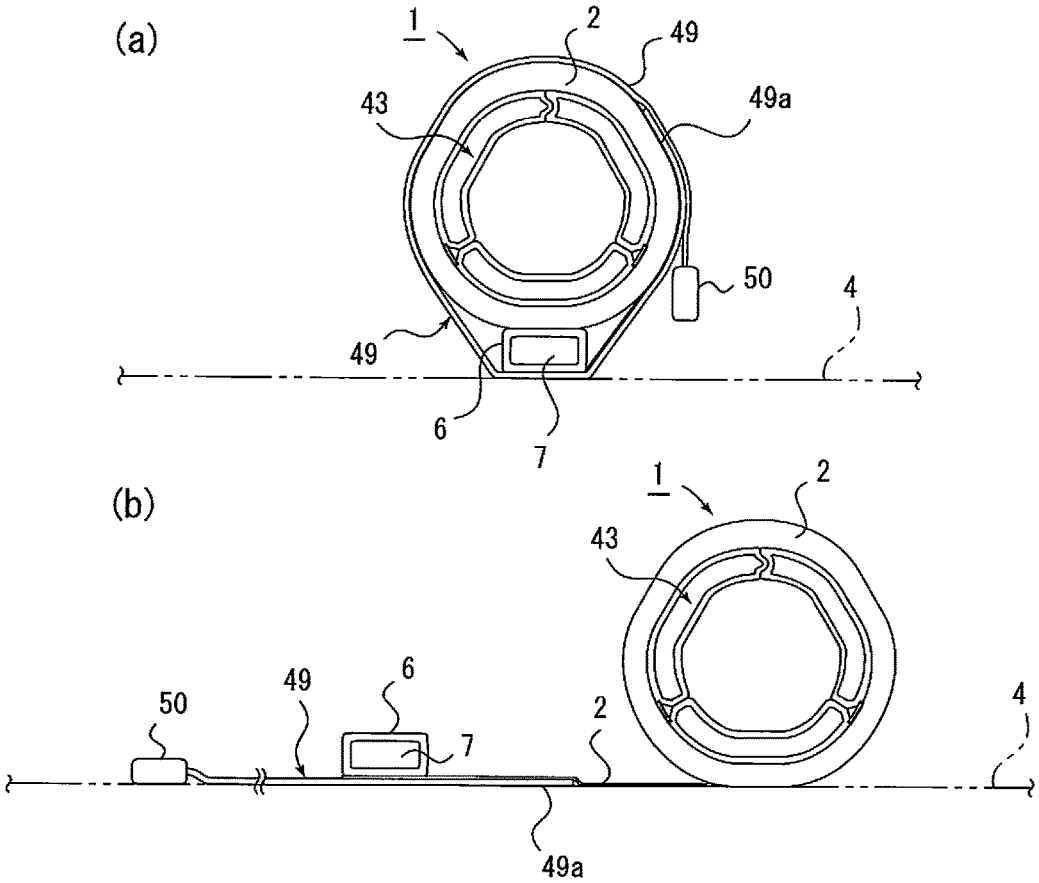
FIG. 9 is a cross-sectional view of the cylindrical winding tool according to a seventh embodiment of the present invention.

Next, the winding device 1 according to the seventh embodiment illustrated in FIG. 9 will now be described. The binding band 49 of this embodiment comprises a hook-and-loop fastener. The proximal end 49*a* of the binding band 49 is fixed to the location where the proximal end 49*a* protrudes beyond the end bar 6 toward the magnet sheet 2.

In addition, the length of the portion of the binding band 49 protruding beyond the end bar 6 toward the outside is in the same or similar manner as in the sixth embodiment, is specified such that it corresponds to the length ensuring that the binding band 49 is wound on the outer circumference of the winding device 1 in the unused state by less than one round of winding. As a result, it is ensured that the protruding portion does not pass the space between the magnetically-attached object 4 and the end bar 6.

By virtue of these features, when the binding band 49 is wound by one round on the winding device 1 in the unused state, the end portion thereof overlaps with the proximal end 49*a* by a required range, and the overlapping portions are fixed to each other by the hook-and-loop fastener.

According to the seventh embodiment, in the same or similar manner as in the sixth embodiment, the winding device 1 in the unused state can be magnetically attached to the magnetically-attached object 4 by the permanent magnet 7 provided in the end bar 6 (see FIG. 9*a*). Further, by removing the end portion of the binding band 49 away from the proximal end 49*a,* the magnet sheet 2 rewound on the cylindrical winding tool 43 can be unrolled on the magnetically-attached object 4 (see FIG. 9*b*).

It should be noted that in the configuration of the seventh embodiment, since the binding band 49 protrudes beyond the end bar 6 toward the magnet sheet 2, part of the binding band 49 in the in-use state of the magnet sheet 2 will be positioned between the magnet sheet 2 and the magnetically-attached object 4.

As a result of this, since creases may be created on the magnet sheet 2 at location where it is overlapped with the binding band 29, it is preferable that, for example, the surface of the magnet sheet 2 in the range where it is overlapped with the binding band 29 is in black so that the surface cannot be used as a writing board and a screen.

In contrast to the sixth and seventh embodiment, the binding band 49 of the winding device 1 according to the third embodiment illustrated in FIG. 5(*b*) is wound on the outer circumference of the magnet sheet 2 by one or more rounds of winding in the unused state of the winding device 1. The portion protruding beyond the end bar 6 toward the outside passes the space between the end bar 6 and the magnetically-attached object 4.

As a result of this, when the magnet sheet 2 rewound on the cylindrical winding tool 43 is to be unrolled on the magnetically-attached object 4, the magnet sheet 2 can be unrolled only when the binding band 49 has been made to pass the space between the end bar 6 and the magnetically-attached object 4.

In other words, it is not possible to unroll the magnet sheet 2 while the end bar 6 is magnetically attached to the magnetically-attached object 4, in addition to which it is not possible to rewind the magnet sheet 2 while the end bar 6 is magnetically attached to the magnetically-attached object 4.

Figure 10:
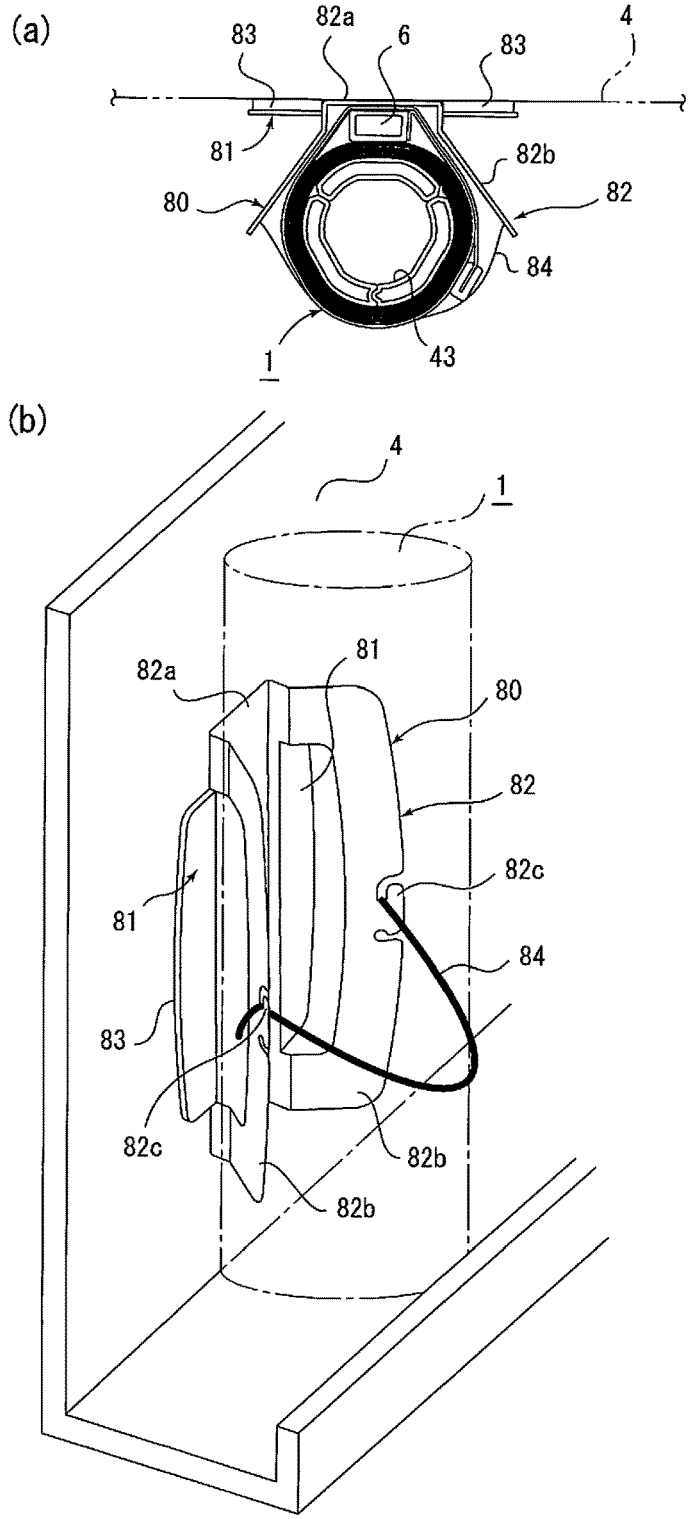
FIG. 10 is a diagram for explanation of a propping tool according to the present invention.

FIGS. 10*a* and 10*b* illustrate a propping tool 80 for the winding device 1. While the sixth and seventh embodiment depicted a configuration where the end bar 6 is magnetically attached to the magnetically-attached object 4 to retain the winding device 1, this embodiment depicts another configuration where the winding device 1 is retained on the magnetically-attached object 4 using the propping tool 80.

The propping tool 80 can be produced by cutting out one iron plate into the required shape and then folding it. The propping tool 80 includes a magnetic attachment section 81 configured to be magnetically attached to the magnetically-attached object and a supporting section 82 protruding frontward from the magnetic attachment section 81 and configured to support the winding device 1.

A permanent magnet 83 is provided on the surface of the magnetic attachment section 81 on the side of the magnetically-attached object 4, by virtue of which the propping tool 80 can be magnetically attached to the magnetically-attached object 4.

The supporting section 82 comprises a flat section 82*a* formed on the side of the magnetically-attached object 4 and an expanded section 82*b* formed such that it obliquely spreads from the flat section 82*a*. The winding device 1 in the unused state is accommodated in the space defined between the flat section 82*a* and the expanded section 82*b*.

Also, a hook 82*c* for engagement of a fall prevention member 84 comprising chain members such as ball chain is formed substantially at the center of the expanded section 82*b*.

By virtue of these features, when the permanent magnet 7 of the end bar 6 does not have sufficient magnetism, the winding device 1 can be retained on the magnetically-attached object 4 using the propping tool 80.

Specifically, the propping tool 80 is magnetically attached in advance to the required location of the magnetically-attached object 4 and, in this state, the winding device 1 in the unused state with the magnet sheet 2 rewound thereon is accommodated in the supporting section 82.

At this point, by accommodating the end bar 6 in a state where it is oriented toward the flat section 82*a* of the supporting section 82, the rewound magnet sheet 2 is placed in equalized contact with the expanded section 82*b* and thus the winding device 1 can be stably retained.

After that, by attaching the fall prevention member 84 to the hook 82*c* provided in the two expanded sections 82*b,* the winding device 1 in the unused state can be retained without causing unintended detachment.

Here, for example, when the winding device 1 is held by a blackboard or a whiteboard which corresponds to the above-described magnetically-attached object 4, the winding device 1 may be supported from below by a chalk tray provided at a lower portion of the blackboard and a marking pen tray provided at a lower portion of the whiteboard.

It should be noted that the hinge connection is not limited to the hinge connection using the above-described magnet sheet 2, the resin hinge using the synthetic resin, or the tape 41. Any specific configuration may be adopted as appropriate along as the abutment section on both of the ends in the circumferential direction of the individual elongated members are autonomously brought into abutment on each other and thus a stable cylindrical winding tool 43 can be configured when the individual elongated members 5, 25, 45, 55, 65 are gathered together in the circumferential direction. A hinge maybe used as another example of the hinge connection.

Also, although the second to fifth embodiments omits the rubber magnet which corresponds to the rubber magnet 8 of the first embodiment, it will be appreciated that the rubber magnet may be provided as required.

Further, while two, three, or eight elongated members constituting the cylindrical winding tool are used in the above-described embodiments, any other number of the elongated members may be used. In addition, the cylindrical winding tool does not need to be configured by a cylindrical member split into pieces at equal intervals in the axial direction, and an elongated member split at uneven intervals may be used. Furthermore, the cylindrical member does not need to be hollow and may be solid.

Also, while the cylindrical winding tools 3, 23, 43, 53, and 63 and the magnet sheet 2 are integrally coupled to each other in the above-described embodiments, each cylindrical winding tool may be configured to be detachably separated from the magnet sheet 2. In this case as well, it will be readily appreciated that the above-described functions and effects of the present invention can be obtained when each cylindrical winding tool is used while it is attached to the magnet sheet 2.

REFERENCE SIGNS LIST

1 magnet sheet winding device
2 magnet sheet
3, 23, 43, 53, 63 cylindrical winding tool
4 magnetically-attached object
5, 25, 45, 55, 65 elongated member
5*a* outer circumferential section
5*b*, 45*c* abutment section
5*a*' end section
5*c*, 27*c*, 45*d*, 55*b* engagement recess
5*a*" central section
5*d*, 27*d*, 45*c* engagement protrusion
8, 28 magnet
10 marking pen
11 eraser
12, 32 holder

What is claimed is:

1. A magnet sheet winding device comprising:

a magnet sheet having flexibility; and a cylindrical winding tool having a required diameter, attached to one side of the magnet sheet, and configured to rewind the magnet sheet, wherein the magnet sheet in an in-use state is unrolled from the cylindrical winding tool and magnetically attached to a magnetically-attached object and the magnet sheet in an unused state is rewound on the cylindrical winding tool, the magnet sheet winding device being characterized in that the cylindrical winding tool comprises a plurality of elongated members obtained by splitting a cylindrical member in an axial direction of the cylindrical member, the elongated members are connected in a hinged state to each other in a circumferential direction, the elongated members are spread in the in-use state such that the elongated members are allowed to be arranged on the magnet sheet unrolled on the magnetically-attached object so as to be flush with the magnet sheet, and the elongated members in the unused state are gathered together in the circumferential direction, and abutment sections of end faces of the adjacent elongated members are brought into abutment on each other so as to form the cylindrical winding tool having the required diameter.

2. The magnet sheet winding device as recited in claim 1, characterized in that end portions in the circumferential direction of an outer circumferential surface of the elongated member are formed in an arcuate shape, and a central section in the circumferential direction thereof is formed in a planar shape.

3. The magnet sheet winding device as recited in claim 1, characterized in that an engagement section is provided at the abutment sections of the elongated members, the engagement sections being configured to be brought into engagement with each other when the elongated members are gathered together, both of the engagement sections being brought into engagement with each other when the elongated members are gathered together so as to adjust positions in the circumferential direction of the elongated members.

4. The magnet sheet winding device as recited in claim 1, characterized in that the hinged state connection comprises the magnet sheet adhesively attached to the elongated members to interconnect the elongated members, a synthetic resin material produced in a state where the elongated members are interconnected, or a tape adhesively attached to the elongated members so as to interconnect the elongated members.

5. The magnet sheet winding device as recited in claim 1, characterized in that a magnet magnetically attaching the elongated member to the magnetically-attached object is provided in the elongated member.

6. The magnet sheet winding device according to claim 1, characterized in that for each elongated member, a magnet is provided at an end of the elongated member defining one side when the elongated members are spread and another magnet is provided at another end of the elongated member defining another side when the elongated members are spread, and both of the magnets are magnetically attached to each other when the elongated members are gathered together so as to maintain a shape of the cylindrical winding tool.

7. The magnet sheet winding device according to claim 1, characterized in that a holder is provided inside the elongated member, the holder being configured to detachably hold either or both of a marking pen and an eraser, and the holder in the unused state is accommodated in the inside of the cylindrical winding tool in a state where the holder holds either or both of the marking pen and the eraser.

8. The magnet sheet winding device according to claim 1, characterized in that an end bar configured to be magnetically attached to the magnetically-attached object is provided at an end of the magnet sheet, a binding band configured to maintain a winding state of the magnet sheet is provided on the end bar, a length of a portion of the binding band protruding beyond the end bar toward an outside is specified to correspond to a length allowing the end bar to be wound around an outer circumference of the magnet sheet wound on the cylindrical winding tool by less than one round of winding, an end portion of the binding band is retained by an outer circumferential surface of the magnet sheet, and the end bar in an unused state is magnetically attached to and retained by the magnetically-attached object.

9. A propping tool for the magnet sheet winding device according to claim 1, characterized in that the propping tool comprises:

a magnetic attachment section configured to be magnetically attached to the magnetically-attached object;

two expanded sections protruding obliquely frontward from the magnetic attachment section; and a fall prevention member provided between ends of the expanded sections, wherein the winding device in the unused state is positioned between the expanded sections in a state where the magnetic attachment section is magnetically attached to the magnetically-attached object, and the fall prevention member is provided in the expanded section to prevent a fall.

* * * * *